United States Patent [19]

Fujii et al.

[11] Patent Number: 4,597,589

[45] Date of Patent: Jul. 1, 1986

[54] PIVOTED GRIP SKI POLE

[76] Inventors: Ray K. Fujii; William K. Brown, both of 2511 S. Troutdale Rd., Troutdale, Oreg. 97060

[21] Appl. No.: 590,148

[22] Filed: Mar. 16, 1984

[51] Int. Cl.[4] ..... A63C 11/22

[52] U.S. Cl. ..... 280/821; 135/66

[58] Field of Search ..... 280/821; 135/74, 66, 135/76, 25 R

[56] References Cited

U.S. PATENT DOCUMENTS

| | | | |
|---|---|---|---|
| 1,054,026 | 2/1913 | Person | 135/74 |
| 1,600,046 | 9/1926 | Goldwin | 135/66 |
| 4,121,605 | 10/1978 | Schmerl | 135/66 |

FOREIGN PATENT DOCUMENTS

| | | | |
|---|---|---|---|
| 2223273 | 12/1972 | Fed. Rep. of Germany | 280/821 |

*Primary Examiner*—Joseph F. Peters, Jr.
*Assistant Examiner*—Joseph G. McCarthy
*Attorney, Agent, or Firm*—Klarquist, Sparkman, Campbell, Leigh & Whinston

[57] ABSTRACT

A ski pole having a grip pivotally mounted on a pole member to enable the grip to move from an in-line position to a transverse position on the pole member. A latch normally holds the grip against pivotal movement. A trip on the grip unlatches the grip for pivotal movement. The trip is so located on the grip that it can be actuated by the thumb of the hand grasping the grip. The pressure on the trip may be relieved after the latch is tripped. A cam arrangement enables the latch to automatically re-engage when the grip is returned to its in-line position.

5 Claims, 5 Drawing Figures

PIVOTED GRIP SKI POLE

This invention relates to ski poles and to improvements in prior ski poles of which we are aware.

It is now common practice for skiers, when pushing off or launching themselves forwardly at the start of a downhill run, to plant the spiked ends of the poles in the snow and give a rearward thrust on both poles, all with the aim of getting the greatest attainable acceleration at the commencement, which is translated into a faster run than would otherwise be the case. In doing the above, skiers usually grip the ski poles in the normal fashion, i.e., form a fist around the handle end of each pole. However, we have discovered that the amount of force that can be developed with the arms when the fists are vertically arranged, as they are in the above described portions, is not as great as when the fists are horizontally disposed.

U.S. Pat. No. 4,062,554 shows a ski pole having an oblique extension on the handle, forming an impact surface, but the extension is affixed to the handle and the arrangement is awkward.

The Swiss Pat. No. 562,041, granted in 1970 and issued in 1975, shows various forms of a ski pole having a pivoted handle or grip portion, but the arrangements are awkward to operate, and are expensive to construct.

The present invention provides a ski pole constructed to readily permit the disposition of the grip in a position for horizontal thrust, wherein the pole facilitates ready pivoting movement of the grip to a vertical in-line position wherein it is latched. Our ski pole is so constructed that while it can be grasped with the grip in its normal in-line position, the grip can be released by a tripping action carried out by the thumb of the very hand which grasps the grip.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the accompanying drawings.

Figure 5:
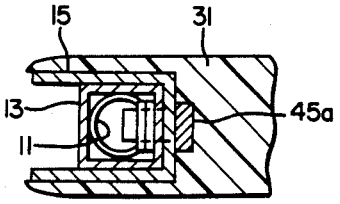
FIG. 5 is a fragmentary cross section taken along line 5—5 of FIG. 3.

Referring to the drawings, the ski pole shown is of standard construction except at its grip end. Thus, it has a tubular pole portion 11 (FIG. 1) of cylindrical form (FIG. 5) equipped at its lower end with a foot including a flare and a spike (not shown). The upper end of the pole portion is fixedly received within a tubular section 13 of square cross section (FIG. 5).

The upper portion of the tubular section 13 is pivoted at 19 to the frame, and is slidably received between the parallel sides 15 of a channel-shaped frame 17.

The frame is fixedly encased within a plastic grip G having a body 31 which is formed with a tubular grasping portion 31*a* and a pair of end retainers 31*b* and 31*c*. The retainers curl back toward one another to leave a space for the hand of the user.

Figure 2:
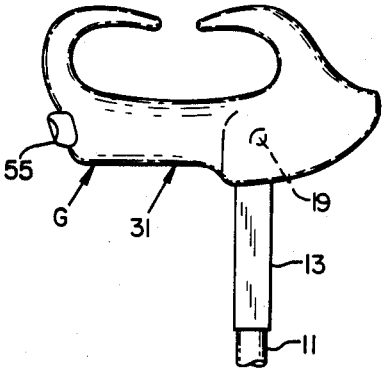
FIG. 2 is a view of the pole with the grip pivoted to its push-off position.

In the FIG. 2 positions of the parts, the grip G of the ski pole is upright and in-line with the pole for normal use. It is releasably held against pivotal movement by a latch. The latter comprises a hook 41 and a catch 43, which are shown in latching engagement in FIG. 3. The catch 43 is formed from a portion of the tubular section 13, to leave a hole to pass the hook 41. The frame 17 is formed with a matching hole 44 to pass the hook.

The hook is carried by the lower end of a longitudinally extending latch release member 45. The latter has a lower portion 45*a* slidably disposed between the back 17*a* of the frame 17 and an inner wall 31*d* formed on the grip body 31.

The latch member has an upper portion 45*b* connected to the lower portion by a dog leg 45*c*. The latter passes through an opening 51 formed in the back 17*a* of the frame.

The dog leg 45*c* is a transition zone where the flat strip-like lower portion 45*a* (FIG. 5) changes form into a rod-like upper portion. The latter slidably projects through a hole formed in a guide tab 53 on the frame 17. If desired, the entire latch member could be of rod-form.

A push button 55 is fixedly secured to the upper end of the upper portion of the latch member and is slidably received within a passageway defined by a bore 61 formed in the grip body 31. The upper end of the frame forms a continuation of the passageway.

A compression spring 63 receives the upper portion of the latch member and is contained in compressed condition between the bottom face of the push button 55 and the upper face of the tab 53. Thus, the spring biasingly holds the hook 41 engaged with the catch 43, and thus releasably holds the grip G in its in-line position.

Figure 1:
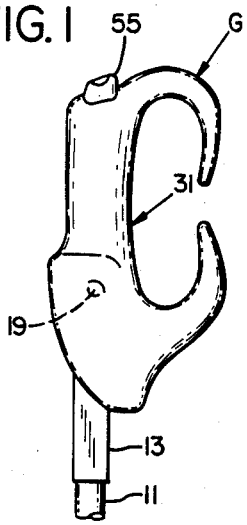
FIG. 1 is an elevational view of the grip end of a ski pole of our invention, with the grip in its normal in-line position.
Figure 3:
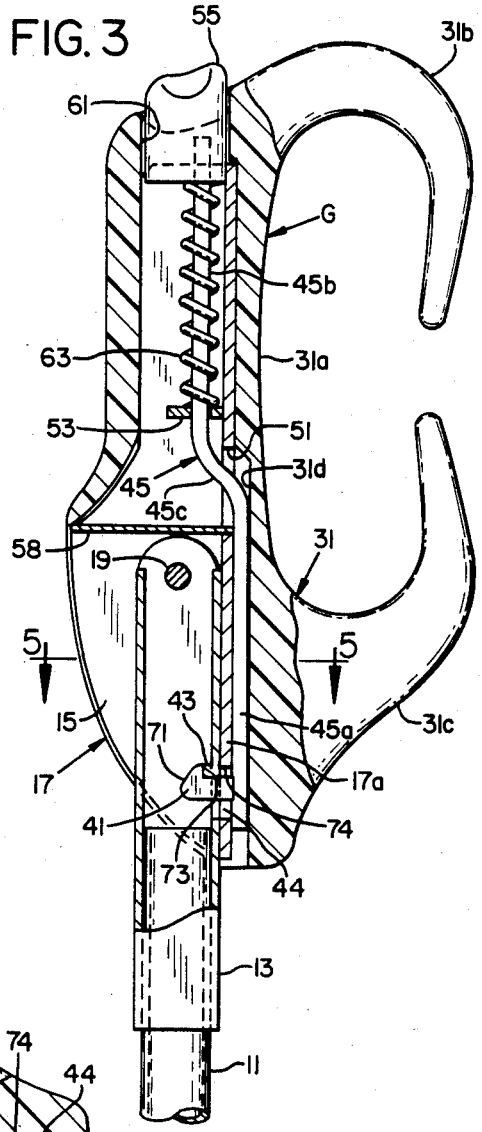
FIG. 3 is an enlarged view of FIG. 1, with certain parts broken back to midsection.

In use, it is contemplated that the skier will use the ski pole with the grip G in its FIGS. 1 and 3 in-line position, for all the usual skiing activities. The skier's hand will have the palm portion next to the right surface of the tubular portion 31*a*, with the fingers and thumb wrapped around such portion, the thumb being uppermost. Thus, the thumb will automatically be disposed adjacent the push button 55, but sufficiently out of the way of the push button, that the thumb must be intentionally moved over the push button, if it is to be depressed.

Figure 4:
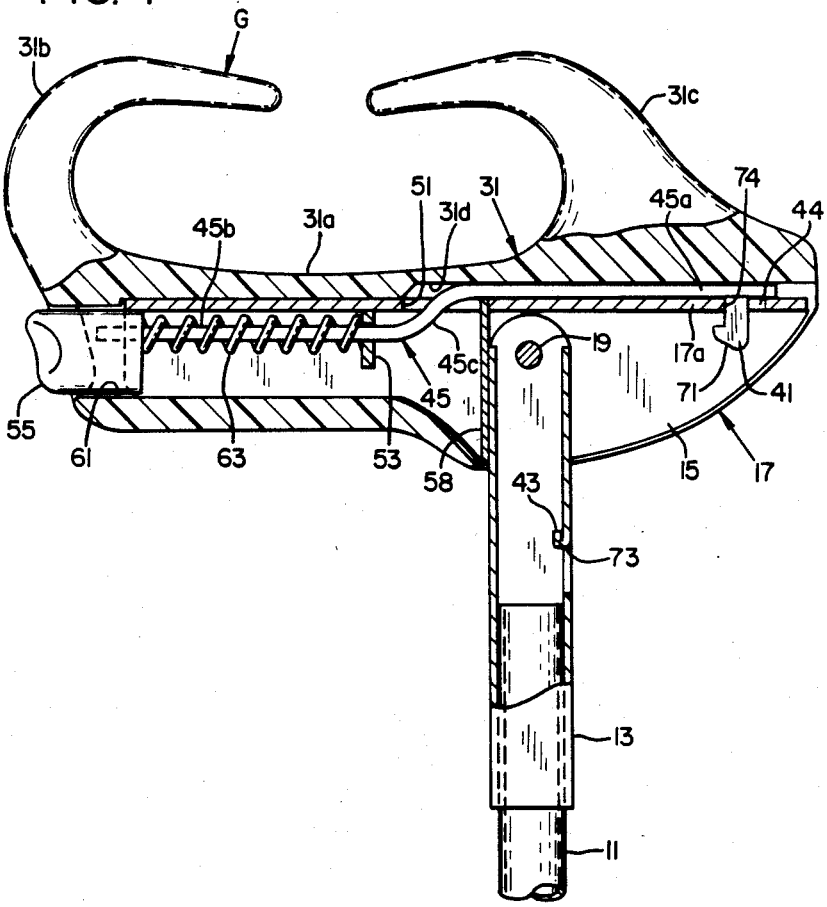
FIG. 4 is a view like FIG. 2 but with parts broken away.

When the skier wants to get great forward thrust, particularly from an at-rest position (such as the starting gate at the top of a ski run), the skier will first maneuver himself or herself into position, with the grip G still in the FIG. 3 position. When the skier is satisfied with his or her position, he or she, while maintaining a good grip with the fingers of each hand, will shift each thumb so as to overlie the associated push button. He or she will then depress each button to unlatch the grips and permit the skier to pivot or turn the grips from in-line positions to transverse or horizontal positions of FIGS. 2 and 4, where a transverse stop plate 58 abuts against the tubular section 13, to limit further travel. Note that the line of applied force is to the left of the pivot 19 in FIG. 4 to hold the grip stop plate against the tubular section 13.

Now the ski poles can serve as ideal instrumentalities for enabling the skier to obtain maximum push-off thrust. Note that once the skier has tripped the latches and the grips have been moved from the latched positions, the skier can release the pressure on the buttons 55, to allow the springs 63 to return the latch members to their upper positions.

Just after the skier has launched himself or herself from the rest position, he or she will want to return the grips to their normal positions. This the skier can do by a simple pivotal movement, the ski pole being specially constructed to enable this to happen. First, note that the hook 41 has an inclined face or cam surface 71, and that the catch 43 has a rounded edge at 73. Second, the upper edge 74 defining the hole 44 limits the upward movement of the released latch member, so as to hold the cam surface in position to engage the rounded edge 73, when the grip is returned to its in-line position.

When the skier pivotally snaps the grips back toward their in-line positions, the cam surfaces 71 will engage the rounded edges 73 and force the latch members to shift downwardly sufficiently, against the resistance of the compression springs, to enable the hooks to bypass the catches and then under the influence of the springs, re-engage with the catches to again releasably hold the grips in their normal in-line positions. Now the skier can complete the run, using the skis in normal fashion, and without concern about the special nature of the grips.

Preferably, the tubular section 13 has frictional engagement with the opposing walls 15 so that the pole portions do not dangle freely. This frictional engagement can be readily overcome by the skier, but it assures that once the grips are arranged cross-wise, they will not inadvertently shift to oblique positions, should the skier shift his or her position at the starting gate.

Preferably, the grip body and the buttons will be formed of plastic, while the remainder will be of metal. The pole portion 11 can be made of aluminum, while the other metal parts can be made of a stronger metal, such as steel, and particularly a rust-resistant steel.

It is contemplated that the tension of the spring 63 can be varied to enable it to be adjusted in accordance with the desires of the user. This can be done in a number of ways, such as by changing springs or by threading the button 55 onto the top of the latch release member 45 or in any other suitable way.

We claim:

1. A ski pole comprising:

a pole member having a longitudinal axis, a grip for the pole member, means for mounting the grip on the pole member for pivotal movement from an in-line position to a transverse position, said grip having a top surface, latch means for releasably latching the grip in its in-line position, said latch means having a trip located on the grip at the top of the grip, means on said grip mounting said trip for movement in the direction parallel to the longitudinal axis of said pole member, said trip being exposed at the top surface of said grip to be actuatable by axial pressure exerted thereagainst.

2. A ski pole as described in claim 1 wherein there are spring means resisting movement of said trip.

3. A ski pole as described in claim 1 wherein said trip projects through said top surface and defines a button for pressure contact.

4. A ski pole as described in claim 3 wherein the trip is located in such adjacency to the grasping portion of the grip as to enable it to be tripped by the thumb of the hand grasping the grip while the hand is in its grasping position.

5. A ski pole as described in claim 1 wherein the latch means includes a longitudinally extending latch member slidably mounted on the grip for endwise movement, a hook on the lower end of said latch member, a catch on the pole member to be engaged by the hook, spring means urging said latch member upwardly, and releasably holding said hook engaged with said catch, and cam means enabling said hook to re-engage with said catch by effecting endwise movement of said latch member.

* * * * *